United States Patent [19]

Dickakian

[11] 4,414,096

[45] * Nov. 8, 1983

[54] CARBON PRECURSOR BY HYDROHEAT-SOAKING OF STEAM CRACKER TAR

[75] Inventor: Ghazi Dickakian, Scotch Plains, N.J.

[73] Assignee: Exxon Research and Engineering Co., Florham Park, N.J.

[ * ] Notice: The portion of the term of this patent subsequent to Jun. 2, 1998 has been disclaimed.

[21] Appl. No.: 275,040

[22] Filed: Jun. 18, 1981

[51] Int. Cl.[3] ..... C10C 1/00; C10C 3/00; C10C 3/02

[52] U.S. Cl. ..... 208/44; 208/40; 208/39

[58] Field of Search ..... 208/44, 39, 40

[56] References Cited

U.S. PATENT DOCUMENTS

| | | | |
|---|---|---|---|
| 4,086,156 | 4/1978 | Dickakian | 208/41 |
| 4,271,006 | 6/1981 | Dickakian | 208/40 |

FOREIGN PATENT DOCUMENTS

| | | | |
|---|---|---|---|
| 27739 | 4/1981 | European Pat. Off. | 208/44 |
| 2376202 | 9/1978 | France | 208/39 |
| 55-94991 | 7/1980 | Japan | 208/44 |
| 701940 | 12/1979 | U.S.S.R. | 208/44 |

*Primary Examiner*—Delbert E. Gantz
*Assistant Examiner*—Helane E. Maull
*Attorney, Agent, or Firm*—Joseph J. Dvorak

[57] ABSTRACT

A feedstock for carbon artifact manufacture is obtained by heat soaking a steam cracker tar or component thereof in a hydrogen atmosphere and thereafter removing 10% to 50% of the oils present therein, if any.

10 Claims, No Drawings

CARBON PRECURSOR BY HYDROHEAT-SOAKING OF STEAM CRACKER TAR

FIELD OF THE INVENTION

The present invention relates to the process for preparing a pitch used in carbon artifact manufacture such as carbon fiber production. More particularly, the present invention relates to a process for preparing a pitch from a steam cracker tar.

BACKGROUND OF THE INVENTION

As is well known, carbon artifacts have been made by pyrolyzing a wide variety of organic materials. Indeed, one carbon artifact of particularly important commercial interest today is carbon fiber. Hence, specific reference is made herein to carbon fiber technology. Nevertheless, it should be appreciated that this invention has applicability to carbon artifact manufacturing generally, and most particularly, to the production of shaped carbon articles in the form of filaments, yarns, films, ribbons, sheets and the like.

Referring now in particular to carbon fibers, suffice it to say, that the use of carbon fibers in reinforcing plastic and metal matrices has gained considerable commercial acceptance where the exceptional properties of the reinforcing composite materials, such as their higher strength to weight ratio, clearly offset the generally higher costs associated with preparing them. It is generally accepted that large scale use of carbon fibers as a reinforcing material would gain even greater acceptance in the marketplace if the costs associated with the formation of the fibers could be substantially reduced. Thus, formation of carbon fibers for relatively inexpensive carbonaceous pitches has received considerable attention in recent years.

Many carbonaceous pitches are known to be converted at the early stage of carbonization to a structurally ordered optically anisotropic spherical liquid crystal called mesophase. The presence of this ordered structure prior to carbonization is considered to be a significant determinant of the fundamental properties of a carbon artifact made from such a carbonaceous pitch. Indeed, the ability to generate high optical anisotropicity during processing is accepted, particularly in carbon fiber production, as a prerequisite for the formation of high quality products. Thus, one of the first requirements of a feedstock material suitable for carbon artifact manufacture, and particularly for carbon fiber production, is its ability to be converted to a highly optically anisotropic material.

In addition to being able to develop highly ordered structures, suitable feedstocks for carbon artifacts manufacture, and in particular carbon fiber manufacture, should have relatively low softening points rendering them suitable for being deformed and shaped into desirable articles. Thus, in carbon fiber manufacture a suitable pitch which is capable of generating the requisite highly ordered structure also must exhibit sufficient viscosity for spinning. Unfortunately, many carbonaceous pitches have relatively high softening points. Indeed, incipient coking frequently occurs in such materials at temperatures where they have sufficient viscosity for spinning. The presence of coke, however, or other infusible materials and/or undesirable high softening point components generated prior to or at the spinning temperatures are detrimental to fiber processability and are believed to be detrimental to fiber product quality.

As is well known, pitches have been prepared from the residues and tars obtained from steam cracking of gas oil or naphtha. In this regard, see, for example, U.S. Pat. Nos. 3,721,658 and 4,086,156. These tarry products typically are composed of alkyl substituted polynuclear aromatics. Indeed, steam cracker tars have relatively high levels of paraffinic carbon atoms, for example, in the range of about 30 atom % to about 35 atom % paraffinic carbon atoms, the presence of which tends to be detrimental on the formation of a suitable anisotropic pitch for carbon fiber production. Additionally, steam cracker tars contain asphaltenes in relatively large quantities, for example, in the range of about 20 to about 30 weight percent. Asphaltenes, as is well known, are solids which are insoluble at paraffinic solvents. The asphaltenes on carbonization tend to form isotropic material, rather than anisotropic material, and hence its presence in steam cracker tars tends to be detrimental in the formation of anisotropic pitch from such steam cracker tars.

As mentioned above, many isotropic carbonaceous pitch materials can be converted to an optically anisotropic phase by thermal treatment of the isotropic material. In the instance of steam cracker tars, however, thermal heat treatment of the steam cracker tars provides an isotropic pitch containing components which have a softening point which is undesirably high, for example, greater than 375° C., for carbon artifact manufacture, particularly for carbon filter manufacture. In other words, the thermal generation of pitches from steam cracker tars has not, heretofore, been known in the art to form pitches having high optical anisotropicity, e.g., greater than 70%, and low softening points and viscosities, e.g., below about 325° C. and 2000 poise (at 360° C.).

SUMMARY OF THE INVENTION

It has now been found that an optically anisotropic pitch can be prepared from steam cracker tars or components thereof, such as vacuum-stripped steam cracker tars or the distillates of steam cracker tars by heat soaking the steam cracker tar or the component thereof in a hydrogen atmosphere.

In one embodiment of the present invention, a steam cracker tar (hereinafter SCT), or a component of a SCT, such as a vacuum-stripped steam cracker tar (hereinafter VS-SCT) or a distillate of a SCT, is subjected to heat soaking at temperatures in the range of about 350° C. to about 450° C. and under a hydrogen atmosphere in the range from about 1 kg/cm$^2$ to about 500 kg/cm$^2$ for a time sufficient to convert the SCT or the component thereof to a pitch suitable for carbon artifact manufacture.

DETAILED DESCRIPTION OF THE INVENTION

The SCT which is used as a starting material in the process of the present invention is defined as the bottoms product obtained when cracking of gas oils, particularly virgin gas oils, naphtha and the like at temperatures of from about 700° C. to about 1000° C. Typical processes are the steam cracking of gas oil and naphtha, preferably at temperatures of 800° C. to 900° C., with 50% to 70% conversion to $C_3$ olefin and lighter hydrocarbons during relatively short times of the order of seconds by stripping at a temperature of about 200° C. to 250° C. to obtain the tar as a bottoms product. A gas oil is, of course, a liquid petroleum distillate with a viscosity and boiling range between kerosene and lubricating oil and having a boiling range between about 200° C. and 400° C. Naphtha is a generic term for refined, partly refined or unrefined petroleum products in liquid products of natural gas not less than 10% of which distill below 175° C. and not less than 95% of which distill below 240° C. as determined by ASTM Method D-86. Such SCT's typically consist of alkyl substituted polycondensed aromatic compounds.

Obviously, the characteristics of a steam cracker tar vary according to the feed in the steam cracking plant; nonetheless, steam cracker tars do possess certain general characteristics or range of properties.

The specification for a typical steam cracking tar that is suitable in the present invention is given in Table 1 below.

TABLE 1

Physical and Chemical Characteristics of Steam Cracker Tars from Naphtha, Gas Oil and Desulfurized Gas Oil Cracking

| | SCT from Naphtha Cracking | SCT from Gas Oil Cracking Ex (1) | SCT from Gas Oil Cracking Ex (2) | SCT from Desulfurized Gas Oil Cracking |
|---|---|---|---|---|
| 1. Physical Characteristics | | | | |
| Viscosity est at 210° F. | 13.9 | 19.3 | 12.4 | 25.0 |
| Coking Value at 550° F. (%) | 12 | 16 | 24 | 25 |
| Toluene Insolubles (%) | 0.200 | 0.200 | 0.250 | 0.100 |
| n-Heptane Insolubles (%) | 3.5 | 16 | 20 | 15 |
| Pour Point (°C.) | +5 | +5 | −6 | +6 |
| Ash (%) | 0.003 | 0.003 | 0.003 | 0.003 |
| 2. Chemical Structure (by carbon and proton NMR) | | | | |
| Aromatic Carbon (atom %) | 65 | 72 | 71 | 74 |
| Aromatic Protons (%) | 34 | 42 | 42 | 38 |
| Benzylic Protons (%) | 40 | 44 | 46 | 47 |
| Paraffinic Protons (%) | 25 | 14 | 12 | 15 |
| Carbon/Hydrogen Atomic Ratio | 0.942 | 1.011 | 1.079 | 1.144 |
| 3. Elemental Analysis | | | | |
| Carbon (wt %) | 91.60 | 90.31 | 88.10 | 90.61 |
| Hydrogen (wt %) | 8.10 | 7.57 | 6.80 | 6.60 |
| Nitrogen (wt %) | 0.15 | 0.10 | 0.15 | 0.18 |
| Oxygen (wt %) | 0.20 | 0.22 | 0.18 | 0.19 |
| Sulfur (wt %) | 0.06 | 1.5 | 4.0 | 1.5 |
| Iron (ppm) | 0.003 | 0.003 | — | — |
| Vanadium (ppm) | 0.000 | 0.001 | — | — |
| Silicon (ppm) | 0.001 | 0.00 | — | — |
| Number Average Molecular Wt. | 295 | 300 | 305 | 315 |

In one embodiment of the present invention, a SCT is hydroheat soaked and subsequently vacuum stripped to provide a pitch which is suitable as a feed material for carbon fiber preparation.

Basically, the hydroheat soaking is conducted by heating the steam cracker tar at temperatures ranging generally from about 350° C. to about 450° C., and preferably from 370° C. to 400° C. in the presence of hydrogen sufficient to provide a hydrogen pressure of from about 1 kg/cm$^2$ to about 500 kg/cm$^2$, and preferably in the range of about 10 kg/cm$^2$ to 250 kg/cm$^2$. The hydroheat soaking is conducted for a time sufficient to generate the requisite amount of pitch. Typically, the hydroheat soaking is conducted for from about 1 minute to about 30 hours, and preferably from about 3 hours to about 20 hours. The time required to produce a satisfactory yield of requisite pitch is very much dependent on the heat soaking temperature used, the hydrogen pressure, and the quantity and type of oil present in the SCT. The less oil present in the heat soaking stage, the greater the rate of formation of the requisite pitch material.

As indicated, after hydroheat soaking the steam cracker tar, the hydroheat soaked material is subjected to a vacuum-stripping step to remove the low boiling fractions present in the hydroheat soaked tar. In general, vacuum stripping is conducted so as to remove from about 10% to about 50% of the low boiling distillate fractions present in the hydroheat soaked SCT. For example, the hydroheat socked SCT can be heated in a vacuum at temperatures ranging generally below about 420° C. at 760 mm Hg, and typically in the range from about 35° C. to 212° C. at pressures below atmospheric, generally in the range from about 2 to 20 mm Hg to remove at least a portion of the low boiling materials presently hydroheat soaked steam cracker tar.

In summary then, one embodiment of the present invention contemplates obtaining a pitch useful for carbon artifact manufacture by the steps of:

(1) hydroheat soaking a SCT; and (2) vacuum stripping the hydroheat soaked tar to provide a pitch.

In an alternate and preferred embodiment of the present invention, the low boiling materials present in the SCT are removed by vacuum-stripping the SCT prior to the hydroheat soaking step. In this optional and preferred embodiment of the present invention, the SCT tar is subjected to vacuum stripping to remove 10 to 50% of the low boiling portion of the steam cracker tar. For example, 50% of a distillate can be separated by heating the SCT in a vacuum at temperatures ranging generally below about 219° C., and typically in the range of about 70° C. to 219° C. under reduced pressure generally in the range of about 4 to 5 mm Hg. Thereafter, the vacuum-stripped steam cracker tar is subjected to a hydroheat soaking in the same manner as described above with respect to the hydroheat soaking of the steam cracker tar which has not been first vacuum-stripped.

To summarize the alternate and preferred embodiment of the present invention, a pitch suitable for carbon artifact manufacture is obtained by the steps of:

(1) vacuum stripping a SCT tar; and, thereafter (2) hydroheat soaking the vacuum stripped SCT.

In yet another embodiment of the present invention, a distillate, especially a heavy distillate of a SCT is hydroheat soaked as described hereinabove. Typically, a heavy distillate of a SCT is one having a boiling point greater than 350° C. at atmospheric pressure, and preferably in the range of about 350° C. to 480° C. at atmospheric pressure.

Thus, in following the procedures outlined above, a pitch is obtained which is useful in carbon artifact manufacture. This pitch, for example, will contain in general 0.5 to 1.0 wt. % of materials insoluble in quinoline at 75° C. In contrast thereto, using heat soaked petroleum pitches from catalytic cracking relations, such pitches typically contain significantly higher amounts of materials insoluble in quinoline at 75° C. Indeed, in some instances, for example, heat soaking a commercially available Ashland pitch, A240, at temperatures in the range of about 400° to 450° C. will produce quinoline insoluble materials in the pitch ranging upwards to about 60%. The quinoline insoluble materials in the case of petroleum pitch which has been obtained from cat cracking reactions generally consist of coke, ash, catalysts fines and the like, and, in addition, the quinoline insoluble materials also include high softening point materials (e.g., greater than 400° C.) generated during the heat soaking of the petroleum pitch. In contrast thereto, SCT's as a pitch precursor do not contain ash and catalyst fines and, consequently, SCT's produce a pitch material which is significantly lower in quinoline insolubles. In carbon fiber manufacture, the quinoline insoluble materials are detrimental to processability of the pitch into fibers, and, consequently, the use of steam cracker tar in producing a pitch for carbon fiber manufacture is particularly advantageous in that it does not contain ash or quinoline insoluble materials in any significant quantities which would otherwise have to be removed.

In utilizing the pitch prepared from the steam cracker tar in accordance with the present invention, particular reference is now made to copending application Ser. No. 29,760, filed Apr. 13, 1979 which application is incorporated herein by reference. Basically, the heat soaked pitch is fluxed, i.e., it is treated with an organic liquid in the range, for example, of from about 0.5 parts by weight of organic liquid per weight of pitch to about 3 parts by weight of fluxing liquid per weight of pitch, thereby providing a fluid pitch having substantially all the quinoline insoluble material suspended in the fluid in the form of a readily separable solid. The suspended solid is then separated by filtration or the like, and the fluid pitch is then treated with an antisolvent compound so as to precipitate at least a substantial portion of the pitch free of quinoline insoluble solids.

The fluxing compounds suitable in the practice of this invention include tetrahydrofuran, toluene, light aromatic gas oil, heavy aromatic gas oil, tetralin and the like.

As will be appreciated, any solvent system, i.e., a solvent or mixture of solvents which will precipitate and flocculate the fluid pitch, can be employed herein. However, since it is particularly desirable in cation fiber manufacture to use that fraction of the pitch which is readily convertible into a deformable, optically anisotropic phase such as disclosed in U.S. Ser. No. 903,172, filed May 5, 1978 (incorporated herein by reference), the solvent system disclosed therein is particularly preferred for precipitating the desired pitch fraction. Typically, such solvent or mixture of solvents includes aromatic hydrocarbons, such as benzene, toluene, xylene and the like and mixtures of such aromatic hydrocarbons with aliphatic hydrocarbon such as toluene-heptane mixtures. The solvents or mixtures of solvents typically will have a solubility parameter of between 8.0 and 9.5, and preferably between about 8.7 and 9.2 at 25° C. The solubility parameter, $\gamma$, of a solvent or mixture of solvents is given by the expression $$\gamma = \left(\frac{H_v - RT}{V}\right)^{\frac{1}{2}}$$

where $H_v$ is the heat of vaporization of the material;

R is the molar gas constant;

T is the temperature in °K.; and

V is the molar volume.

In this regard, see, for example, J. Hildebrand and R. Scott, "Solubility of Non-Electrolytes," 3rd Edition, Reinhold Publishing Company, New York (1949), and "Regular Solutions," Prentice Hall, New Jersey (1962). Solubility parameters at 25° C. for hydrocarbons and commercial $C_6$ to $C_8$ solvents are as follows: benzene, 8.2; toluene, 8.9; xylene, 8.8; n-hexane, 7.3; n-heptane, 7.4; methylcyclohexane, 7.8; bis-cyclohexane, 8.2. Among the foregoing solvents, toluene is preferred. Also, as is well known, solvent mixtures can be prepared to provide a solvent system with the desired solubility parameter. Among mixed solvent systems, a mixture of toluene and heptane is preferred having greater than about 60 volume % toluene, such as 60% toluene/40% heptane and 85% toluene/15% heptane.

The amount of solvent employed will be sufficient to provide a solvent insoluble fraction capable of being thermally converted to greater than 75% of an optically anisotropic material in less than 10 minutes. Typically the ratio of solvent to pitch will be in the range of about 5 millimeters to about 150 millimeters of solvent to a gram of pitch. After heating the solvent, the solvent insoluble fraction can be readily separated by techniques such as sedimentation, centrifugation, filtration and the like. Any of the solvent insoluble fraction of the pitch prepared in accordance with the process of the present invention is eminently suitable for carbon fiber production.

A more complete understanding of the process of this invention can be obtained by reference to the following examples which are illustrative only and are not meant to limit the scope thereof which is fully disclosed in the hereinafter appended claims.

In the examples which follow, the toluene insoluble fraction of the pitch obtained was separated by the following procedure:

(1) 40 grams of crushed sample were mixed with 40 grams of toluene and the mixture refluxed for 1 hour. After cooling to about 95° C., the mixture was filtered using a 10 to 15 micron fritted glass filter.

(2) The filtrate was then diluted with toluene in a 1 to 8 ratio and after standing, the precipitated solids were separated by filtration using a 10 to 15 micron fritted glass filter.

(3) The filter cake was washed with 80 milliliters of toluene, reslurried and mixed for 4 hours at room temperature with 120 milliliters of toluene filter using a 10 to 15 micron glass filter.

(4) The filter cake was washed with 80 milliliters of toluene followed by a wash with 80 milliliters of heptane, and finally the solid was dried at 120° C. under reduced pressure (28–30 in Hg) for 24 hours.

The optical anisotropicity of the isolated solvent insoluble pitch was determined by first heating the pitch to its softening point, and then, after cooling, placing a sample of the pitch on a slide with Permount, a histological medium sold by the Fischer Scientific Company, Fairlawn, N.J. A slip cover was placed over the slide and by rotating the cover under hand pressure, the mounted sample was crushed to a powder and evenly dispersed on the slide. Thereafter, the crushed sample was viewed under polarized light at a magnification factor of 200× and the percent optical anisotropicity was estimated. In all instances, the optical anisotropicity was greater than 75%.

The melting point of the isolated pitch was determined by charging about 20–30 mg of the powdered samples into an NMR sample tube under nitrogen. The tube was flushed with nitrogen and sealed. Thereafter, the tube was placed in a metal block apparatus, heated and the melting point was considered to be the point where the powder agglomerated into a solid mass.

The average molecular weight was determined by gel permeation chromatography using 1,2,4 trichlorobenzene as the solvent and a UV-spectrophotometer at wavelength 320 mm as the detector.

EXAMPLE 1

500 grams of a SCT was introduced in an electrically heated autoclave and closed. The autoclave was flushed with nitrogen to remove the air and then pressurized with nitrogen to 10 kg/cm$^2$.

The tar in the autoclave was then heated with agitation to 370° C. The pressure in the autoclave increased to 70 kg/cm$^2$. The tar was heated for 12 hours and then the temperature was reduced to room temperature.

The heat-soaked tar was next transferred to a distillation flask and heated under reduced pressure to distill off all distillable oils. The distillation data is given in Table 2 below.

TABLE 2

| Fraction | Vol. % | Vapor Temperature (°C.) at 760 mm Hg |
|---|---|---|
| 1 | 5 | 270 |
| 2 | 10 | 313 |
| 3 | 15 | 327 |
| 4 | 20 | 334 |
| 5 | 25 | 342 |
| 6 | 30 | 368 |
| 7 | 35 | 390 |
| 8 | 40 | 410 |
| 9 | 45 | 428 |
| 10 | 48 | 438 |

The yield and properties of the pitch are as follows:
(a) Pitch yield = 53.9%.
(b) Softening point of pitch = 120° C.
(c) Toluene insolubles = 22%.
(d) Melting point of toluene insolubles = 400–450° C.
(e) Average molecular weight of toluene insolubles = 516.

EXAMPLE 2

500 grams of a SCT was charged to an electrically heated autoclave and then closed. The autoclave was then flushed with hydrogen to remove the air and pressurized with hydrogen to 17 kg/cm$^2$.

The autoclave was then heated to 370° C. for 21 hours with continuous agitation and then cooled to room temperature. The heat-soaked mixture was transferred to a distillation flask and vacuum-stripped (1–3 mm Hg) to remove all distillable oils. The distillation data is given in Table 3 below.

TABLE 3

| Fraction | Vol. % | Vapor Temperature (°C.) at 760 mm Hg |
|---|---|---|
| 1 | 5 | 251 |
| 2 | 10 | 275 |
| 3 | 15 | 295 |
| 4 | 20 | 313 |
| 5 | 25 | 340 |
| 6 | 30 | 366 |
| 7 | 35 | 390 |
| 8 | 40 | 406 |
| 9 | 45 | 420 |

The yield and properties of the pitch are as follows:
(a) Pitch yield = 57.5 wt. %.
(b) Softening point of pitch = 116° C.
(c) Toluene insolubles = 21%.
(d) Melting point of toluene insolubles = 300°–325° C.
(e) Average molecular weight of toluene insolubles = 425.

EXAMPLE 3

Example 2 was repeated in full with the exception that the heat-soaking was conducted at 390° C. for 20 hours. The heat-soaked mixture was then vacuum distilled under reduced pressure to a maximum vapor temperature of 415 C./760 mm Hg.

The pitch yield was 56.2%; the toluene insolubles yield was 29 wt. % (melting point 300°–325° C.).

As can be seen from the foregoing, heat soaking a SCT in the presence of hydrogen provides a pitch with a significantly lower melting point than that obtained in the absence of hydrogen.

What is claimed is:

1. A process for preparing a pitch suitable for carbon artifact manufacture comprising:

heat soaking a steam cracker tar or a component of a steam cracker tar in a hydrogen atmosphere for a time sufficient to provide a pitch suitable for carbon artifact manufacture.

2. The process of claim 1 wherein said heat soaking is at temperatures ranging from about 350° C. to about 450° C.

3. The process of claim 2 wherein said heat soaking is at temperatures ranging from about 370° C. to about 400° C.

4. The process of claim 2 or 3 wherein said hydrogen is sufficient to provide a pressure of from about 1 kg/cm$^2$ to about 500 kg/cm$^2$.

5. The process of claim 4 wherein a steam cracker tar is heat soaked and wherein said heat soaked steam cracker tar is vacuum stripped to remove from about 10% to about 50% of the low boiling components present.

6. The process of claim 4 wherein said component of a steam cracker tar is a vacuum stripped steam cracker tar.

7. The process of claim 4 wherein said component of the steam cracker tar is a heavy distillate thereof.

8. A process for providing a pitch capable of being converted into greater than 75% of an optically anisotropic phase and suitable in carbon artifact manufacture comprising:

heat soaking a vacuum stripped steam cracker tar at temperatures ranging from about 350° C. to about 450° C. in a hydrogen atmosphere of from about 1 kg/cm$^2$ to about 500 kg/cm$^2$ pressure for a time sufficient to provide a pitch suitable for carbon artifact manufacture.

9. A process for providing a pitch capable of being converted into greater than 75% of an optically anisotropic phase and suitable in carbon artifact manufacture comprising:

heat soaking a steam cracker tar at temperatures ranging from about 350° C. to about 450° C. in a hydrogen atmosphere of from about 1 kg/cm$^2$ to about 500 kg/cm$^2$ pressure for a time sufficient to provide a heat soaked steam cracker tar;

vacuum stripping said heat soaked steam cracker tar at temperature below about 420° C. to remove from about 10% to about 50% of the low boiling fractions present in said heat soaked tar whereby a pitch suitable for carbon artifact manufacture is obtained.

10. A process for providing a pitch capable of being converted into greater than 75% of an optically anisotropic phase and suitable in carbon artifact manufacture comprising:

heat soaking a heavy distillate of a steam cracker tar boiling in the range of about 350° C. to about 480° C. in a hydrogen atmosphere of from about 1 kg/cm$^2$ to about 500 kg/cm$^2$ pressure for a time sufficient to provide a pitch suitable for carbon artifact manufacture.

* * * * *